United States Patent [19]

Germer

[11] 4,368,672

[45] Jan. 18, 1983

[54] SECONDARY SUSPENSION SYSTEM FOR A RAILWAY CAR

[75] Inventor: John A. Germer, Doylestown, Pa.

[73] Assignee: The Budd Company, Troy, Mich.

[21] Appl. No.: 220,804

[22] Filed: Dec. 29, 1980

[51] Int. Cl.[3] ..... B61F 3/004

[52] U.S. Cl. ..... 105/199 R; 105/197 DB; 105/199 F; 105/199 CB; 267/3; 267/9 A; 384/423

[58] Field of Search ..... 105/199 R, 199 CB, 199 A, 105/199 F, 199 S, 200, 197 R, 197 B, 197 D, 197 DB, 197 DP, 197 A, 197.1, 198, 208, 208.1, 208.2, 452, 179, 199 C; 267/3, 9 A

[56] References Cited

U.S. PATENT DOCUMENTS

Re. 28,815 5/1976 Schmiterlow ..... 105/199 R
2,954,745 10/1960 Lich ..... 105/208.1 X
3,895,206 7/1975 Smedley et al. ..... 105/199 F
4,196,671 4/1980 Herring, Jr. et al. ..... 105/199 R

FOREIGN PATENT DOCUMENTS 193571 9/1967 U.S.S.R. ..... 105/199 R

*Primary Examiner*—Joseph F. Peters, Jr.
*Assistant Examiner*—M. J. Hill
*Attorney, Agent, or Firm*—Edward M. Farrell; Herman Foster; Thomas I. Davenport

[57] ABSTRACT

A secondary suspension system includes a pair of air springs connected between the bolster of a truck and the car body. The air springs are disposed at angles extending inwardly from opposite ends of the bolster towards the center of the car body to provide both vertical and lateral suspension for the car body.

2 Claims, 4 Drawing Figures

FIG. 1
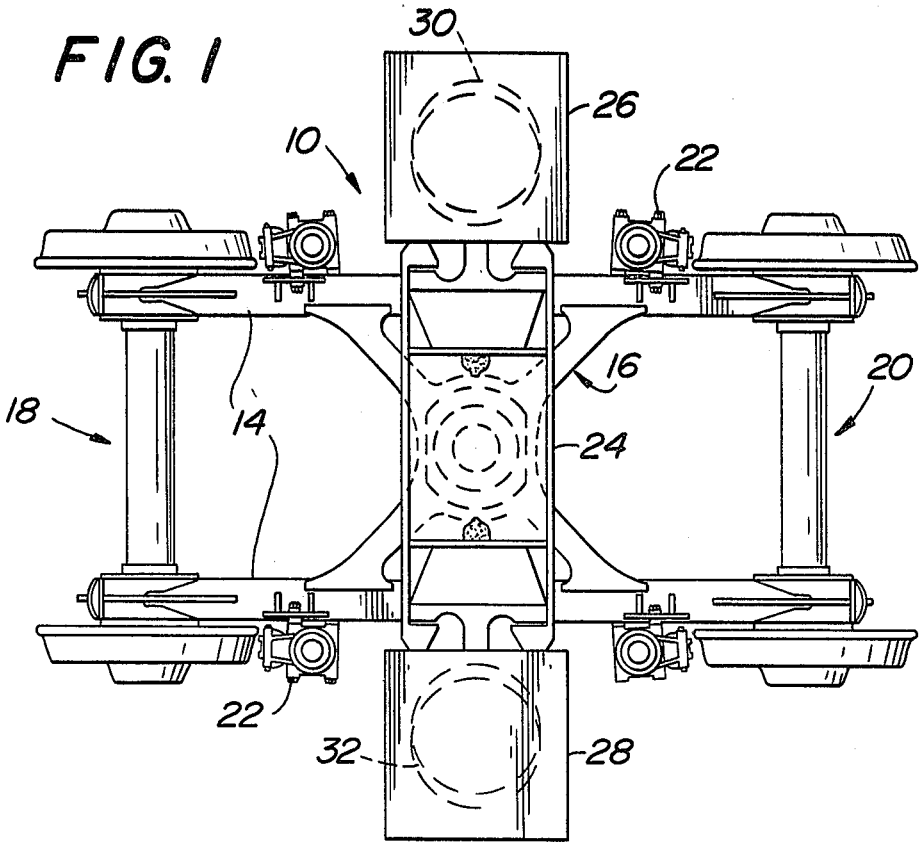
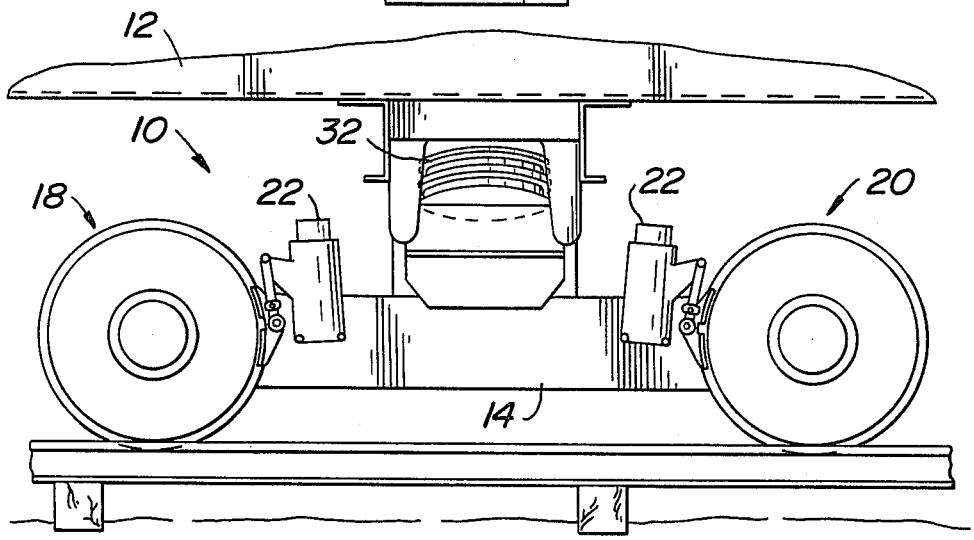
FIG. 2

SECONDARY SUSPENSION SYSTEM FOR A RAILWAY CAR

BACKGROUND OF THE INVENTION

The superiority of air spring suspension on railcars have been recognized for years. One reason for this is that air springs provide a better vertical ride and is quieter than other types of suspension systems involving mechanical springs and parts.

One of the problems involved in the use of air springs is that such air springs have a very low lateral spring rate. An auxiliary lateral spring arrangement must generally be used if a quality lateral ride is desired.

Another problem with air springs is that they may lose air and collapse. Rubber blocks are often installed inside the air bags at some specified distance under the car body. This would be an acceptable solution if the car is moving slow. However, the vertical spring rate of the rubber block is so high that at high speeds the vibration of the car becomes intolerable. At the same time, this rubber block offers very little lateral spring effect again resulting in an uncomfortable car ride. Other types of emergency springs have been used in case of air spring failure, but generally the use of such emergency springs have involved either an uncomfortable ride or required that the car be moved at a relatively low speed. In addition to effecting riding comfort, overall design requirements for new railway cars often require sufficient vertical and lateral spring rates in the event of air bag failure.

Emergency vertical air springs having a non-linear type spring response are known. Such springs have a high spring rate up to the weight of the car, a low spring rate in the range of loading the car and then a high spring rate above the maximum load of the car. Such types of springs alone, however, while providing satisfactory vertical spring rates under emergency conditions, do not provide adequate lateral spring rates.

OBJECTS OF THE INVENTION

It is an object of this invention to provide an improved secondary suspension system for a railway car.

It is a further object of this invention to provide an improved secondary suspension system for a railway car with improved means for providing both vertical and lateral suspension.

It is still a further object of this invention to provide a secondary suspension system for a railway car with improved lateral suspension means under normal conditions and emergency conditions in case of air spring failure.

BRIEF SUMMARY OF THE INVENTION

In accordance with the present invention, a pair of air springs is disposed between the car body and the bolster of a truck. The air springs extend from the ends of the bolster at inward angles towards the center of the car body to provide both vertical and lateral suspension for the car body. In the event of air spring failures, a non-linear type emergency spring providing vertical suspension is used in conjunction with a rubber shear spring to provide lateral suspension.

Other objects and advantages of the present invention will be apparent and suggest themselves to those skilled in the art, from a reading of the following specification and claims, taken in conjunction with the accompanying drawing, in which:

BRIEF DESCRIPTION OF THE DRAWINGS

FIG. 1 is a top view of a typical truck for supporting a railway car with a suspension system of the type involved in the present invention;

FIG. 2 is a side view of the truck illustrated in FIG. 1, along with a car body thereon;

DETAILED DESCRIPTION OF THE INVENTION

Figure 3:
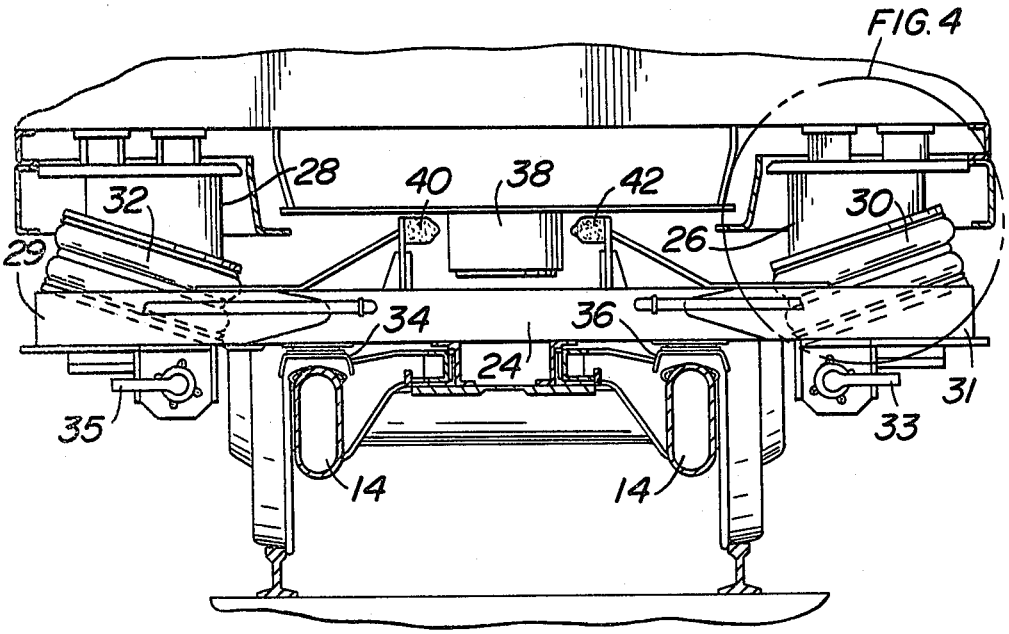
FIG. 3 is a view, partly in cross-section, of a part of a railway car body and truck illustrated in FIGS. 1 and 2 and including the suspension system involved in the present invention.

Referring particularly to FIGS. 1 and 2, a typical truck assembly 10 is disposed to support a railway car body 12. The truck 10 includes conventional side frames 14 having a spider frame arrangement 16 disposed therebetween. Wheel-axle units 18 and 20 are connected to the side frames 14. Suitable braking devices 22 are secured to the side frames in close proximity to the wheels of the wheel-axle units. All of these various elements are well known to those skilled in the art.

A bloster 24 is connected to the side frames 14 and include a pair of spring mounting blocks 26 and 28 disposed toward the ends thereof. Air spring units 30 and 32 are secured to the mounting blocks 26 and 28, respectively, between the bolster 24 and the car body 12. The spring units, which specifically involve the present invention, will be described in detail in connection with FIGS. 3 and 4. Except for the suspension springs to be described, the various elements illustrated in FIGS. 1 and 2 are conventional.

As illustrated in FIG. 3, the bolster 24 is connected through side bearings 34 and 36 to the side frames 14. The side bearings 34 and 36 may also be of conventional design. Other elements which are conventional illustrated in FIG. 3 include a center sill 38 extending from the car body and lateral bumper stops 40 and 42 which limit the movement of the car laterally with respect to the truck. Conventional shock absorbers 33 and 35 are also included in the system illustrated.

The spring units 30 and 32 comprise air springs. Such air springs are inflated with air under pressure and in the past have been used to provide vertical suspension for railway cars. The air springs 30 and 32 are secured at one end to mounting blocks. 26 and 28, respectively. The blocks 26 and 28 include bottom angular sections to receive the springs thereon at angles.

The air springs 30 and 32 are connected to the spring pocket seats 29 and 31 on the bolster at an angle extending inwardly toward the center of the car body. The tops of the air springs 30 and 32 are secured to spring mounting blocks 26 and 28 which also include angular bottom portions to receive the top angular position of the springs 30 and 32.

The angles of the springs 30 and 32 extend inwardly and upwardly from the ends of the bolster 24 towards the center of the car body. The angles of the springs are preferably between 14 and 25 degrees from the vertical plane of the car body. If the springs were inclined outside of this range, the overall advantage of providing both vertical and lateral suspension with a single pair of springs would not be achieved and additional springs for vertical suspension would be required.

The disposition or angular positions of the air springs 30 and 32 provide both vertical and lateral suspension for the railway car 12. Thus, instead of the need to provide additional auxiliary lateral suspension means with vertical air springs, only a single air spring or pair of air springs are required.

Both springs 30 and 32 must both extend at opposite angles inwardly toward the center of the car. If both springs were inclined in the same direction, only one lateral suspension result would be achieved.

Having the two springs 30 and 32 disposed at opposite angles also provide improved means for minimizing the rolling effect of the car as the car tends to go around turns. The reason for this is that the rolling of the car body will be resisted by one or the other springs and as the car tends to move up or down the top angular portions of the air spring seats 29 and 31.

Figure 4:
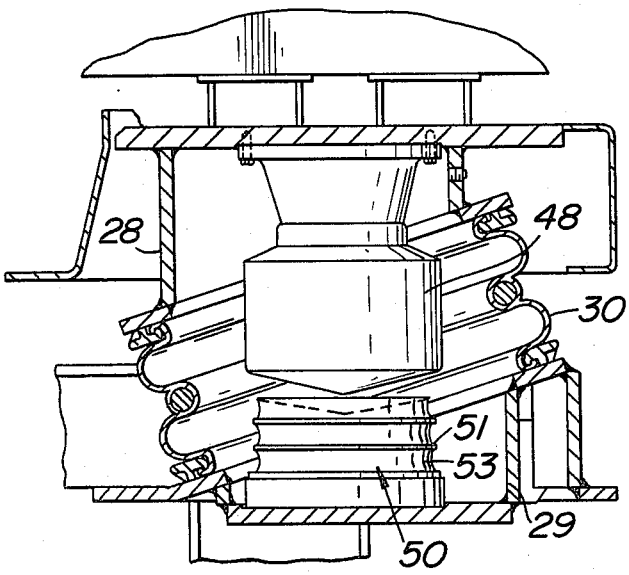
FIG. 4 is an enlarged cross-sectional view of one of the spring arrangements, illustrated in the circle in FIG. 3.

Referring to FIG. 4, an emergency spring arrangement is also provided within the air spring 30. This emergency spring includes a non-linear type spring 48 which is connected to the mounting block 28. Such springs are hydraulic, pneumatic, elastomer combination springs and may be of the type manufactured by Gould, Inc. of Milan, Ohio. This spring 48 may be mounted with a one inch gap below the floor. Such springs have a high spring rate up to the weight of the car, then has a low spring rate in the range of loading of the car and then have a high spring rate above the maximum load of the car. The spring 48 is designed primarily to provide vertical suspension for the car body in the event that the air to the springs 30 and 32 fail. Because such springs are in general very hard in the lateral direction, they do not provide sufficient lateral suspension means.

As mentioned, in order again to provide improved lateral suspension during normal operation or during emergency operation, an emergency spring system is provided within each air spring. The emergency spring system includes a lateral suspension spring 50 connected to the seat 29 in spaced relationship below the spring 48. If the air spring 30 fails, the spring 48 lowers and comes in contact with the spring 50. The spring 48 then provides the vertical suspension while the lower spring 50 provides the lateral suspension. The lateral suspension spring 50 comprises a multi-layered thin steel plate 51 between rubber blocks 53 which provide a shear spring.

The main feature of the present invention is that it provides for an improved lateral suspension system. This improved lateral suspension system is provided during normal operation without the necessity of an additional spring for lateral suspension when an air vertical spring is used. An improved lateral suspension system is also provided during an emergency mode of operation by the spring 50. This makes it possible to utilize a non-linear spring 48 with all its attendant advantages without sacrificing lateral spring rate.

What is claimed is:

1. In combination with a railway car including a main body and a truck having a bolster, a combined lateral and vertical suspension system comprising:

(a) angular mounting blocks secured to said main body;

(b) angular spring seats secured to said bolster;

(c) a pair of air springs extending upwardly and inwardly from said angular spring seats secured to said bolster towards the center of said main body to said mounting blocks at angles between it and 25 degrees from the vertical plane of said main body;

(d) emergency spring means secured within each of said pair of air springs normally inoperative and becoming operative when one of said air springs fail;

(e) said emergency spring means including a non-linear spring secured to one of said mounting blocks and a lateral suspension spring normally spaced from said non-linear spring and secured to one of said spring seats; and (f) said lateral suspension spring comprising a plurality of thin metal plates disposed between rubber blocks, whereby vertical and lateral suspension is provided for said railway car during normal operating conditions and during emergency operating conditions when said air springs fail.

2. The combination as set forth in claim 1 wherein said spaced non-linear spring and lateral suspension springs come in contact with each other when their associated spring fails.

* * * * *

UNITED STATES PATENT OFFICE

CERTIFICATE OF CORRECTION

PATENT NO. : 4,368,672

DATED : January 18, 1983

INVENTOR(S) : John A. Germer

It is certified that error appears in the above-identified patent and that said Letters Patent are hereby corrected as shown below:

Claim 1, column 4, line 23, change "it" to --14--.

Signed and Sealed this

*Nineteenth* Day of *April 1983*

[SEAL]

*Attest:*

GERALD J. MOSSINGHOFF

*Attesting Officer*

*Commissioner of Patents and Trademarks*